US010648142B2

(12) United States Patent
Gremling

(10) Patent No.: US 10,648,142 B2
(45) Date of Patent: May 12, 2020

(54) SPACER FOR ROAD SAFETY BARRIER

(71) Applicant: ArcelorMittal, Luxembourg (LU)

(72) Inventor: Michaël Gremling, Seraing (BE)

(73) Assignee: ArcelorMittal, Luxembourg (LU)

( * ) Notice: Subject to any disclaimer, the term of this patent is extended or adjusted under 35 U.S.C. 154(b) by 177 days.

(21) Appl. No.: 15/562,367

(22) PCT Filed: Apr. 2, 2015

(86) PCT No.: PCT/IB2015/000441
§ 371 (c)(1),
(2) Date: Sep. 27, 2017

(87) PCT Pub. No.: WO2016/156899
PCT Pub. Date: Oct. 6, 2016

(65) Prior Publication Data
US 2018/0282957 A1 Oct. 4, 2018

(51) Int. Cl.
*E01F 15/04* (2006.01)

(52) U.S. Cl.
CPC ..... *E01F 15/0438* (2013.01); *E01F 15/043* (2013.01); *E01F 15/0423* (2013.01)

(58) Field of Classification Search
CPC .. E01F 15/0438; E01F 15/043; E01F 15/0423
USPC ..... 256/13.1
See application file for complete search history.

(56) References Cited

U.S. PATENT DOCUMENTS 3,438,611 A * 4/1969 Giavotto ..... E01F 15/0438 256/13.1
5,876,020 A * 3/1999 Giavotto ..... E01F 15/0423 256/1
6,007,269 A * 12/1999 Marinelli ..... E01F 15/0438 256/13.1
7,249,908 B2 * 7/2007 Bergendahl ..... E01F 15/025 256/13.1
7,530,548 B2 * 5/2009 Ochoa ..... E01F 15/0423 256/13.1
7,794,173 B2 * 9/2010 Amengual Pericas ..... E01F 15/0438 256/13.1

(Continued)

FOREIGN PATENT DOCUMENTS

AT 409004 5/2002
AT 11255 U1 * 7/2010 ..... E01F 15/0438

(Continued)

*Primary Examiner* — Jonathan P Masinick
(74) *Attorney, Agent, or Firm* — Davidson, Davidson & Kappel, LLC

(57) ABSTRACT

The present invention provides a spacer for a road safety barrier. The spacer includes a post and a rail connected to the post via an intermediary of the spacer and a connector. The spacer includes a rail support having a front face intended to be fastened to a rail, a rear face intended to be fastened to a post and a flange that connects the front face to the rear face. The front face includes a notch emerging on the upper edge of the front face, the notch includes a connector housing, located in the lower portion of the notch and two convergent lateral edges connecting the connector housing to the upper edge of the front face. The present invention also provides a safety barrier including a spacer and a fabrication kit for a safety barrier.

20 Claims, 4 Drawing Sheets

(56) References Cited

U.S. PATENT DOCUMENTS

| | | | | |
|---|---|---|---|---|
| 7,997,824 | B2 * | 8/2011 | Amengual Pericas | E01F 15/0453 256/13.1 |
| 8,770,551 | B2 * | 7/2014 | Li | E01F 15/0438 256/13.1 |
| 9,453,312 | B2 * | 9/2016 | James | E01F 15/02 |
| 2002/0053664 | A1 * | 5/2002 | Moore | E01F 15/0438 256/13.1 |
| 2009/0196689 | A1 * | 8/2009 | Pellegrino | E01F 15/043 404/72 |
| 2014/0145132 | A1 | 5/2014 | Leonhardt et al. | |

FOREIGN PATENT DOCUMENTS

| | | | | |
|---|---|---|---|---|
| EP | 0519851 | A1 | 4/1995 | |
| EP | 1391558 | A1 * | 2/2004 | E01F 15/0438 |
| EP | 2159326 | A2 * | 3/2010 | E01F 15/0423 |
| EP | 2180098 | A1 | 4/2010 | |
| EP | 2397610 | | 12/2011 | |
| EP | 2573271 | A2 * | 3/2013 | E01F 15/043 |
| FR | 2848578 | A1 * | 6/2004 | E01F 15/043 |
| WO | 0227104 | | 4/2002 | |

* cited by examiner

SPACER FOR ROAD SAFETY BARRIER

This invention relates to a spacer designed for the construction of road safety devices and more particularly a spacer for a road safety barrier of the type comprising a post and a rail connected to the post via the intermediary of the spacer.

BACKGROUND

It is known that safety barriers can be used along roads to prevent vehicles whose drivers have lost control from leaving the road.

However, the wide variety of vehicles traveling on the roads makes it necessary to resort to safety barriers, the restraining level of which is appropriate to the types of vehicle so that, on the one hand, a car or other lightweight vehicle will not be crushed against a barrier that is too rigid and on the other hand a truck or heavier vehicle does not cross the safety barrier.

In particular, in the event of a collision, the rail must be capable of restraining both a lightweight vehicle, the center of gravity of which is low to the ground, as well as a heavy vehicle, the center of gravity of which is much higher.

EP2 180 098 describes the use of a safety barrier comprising a spacer in the form of a bent tab, whereby the spacer comprises, from its lower end to its upper end, a first fastening area to the post, a first spacer area designed to move a portion of the spacer away from the post, a fastening area to the rail, a second spacing area and a second fastening area to the post in the form of a return leg of the tab downward, whereby this second fastening area is located in the plane of the first fastening area.

Each of the two fastening areas comprises a notch in the shape of an upside-down V at each of the ends of the spacer. The bolts that connect the spacer to the post are positioned in the throat of the V, in other words in the upper position of the indentation. When a vehicle strikes a safety barrier comprising the spacer and begins to bend a post, the spacer is at the same time driven downward by the post and is caused to remain in place by the set of rails of the safety barrier. The effect of these antagonistic forces is to make the bolts connecting the spacer to the post jump out of their notch, thereby releasing the spacer from the post. The rail thus released from the post prevents the vehicle from passing above the rail.

However, the solution proposed by EP2 180 098 has the disadvantage that it results in the detachment of the rail in the event of impacts by lightweight vehicles. Bolts, even when well tightened, have a very small surface area in contact with the notch and jump out of the notch as the result of minor impacts. The risk that a lightweight vehicle will pass underneath the rail is therefore high.

In addition, the time the rail is released from the post is controlled directly by the tightening torque of the bolts that connect the spacer to the post. However, the tightening torque varies as a function of the expansion of the materials, which are subject to climatic variables. This solution is therefore not very reliable because the rail risks being released from the post even by minor impacts and as a result of variable forces exerted on the safety barrier.

Finally, this solution is not compatible with the need to have safety barriers that have a good level of restraint both for lightweight vehicles and for heavy vehicles.

SUMMARY OF THE INVENTION

An object of this invention is to remedy the problems described above by making available a spacer for a road safety barrier of the type comprising a post and a rail connected to the post via the intermediary of the spacer, which is capable of holding the rail in position in response to a force exerted that is less than a threshold value, corresponding to the impact of a lightweight vehicle, and is capable of making the rail rise in response to a force exerted that is greater than the threshold value, corresponding to the impact of a heavy vehicle.

The present invention provides a spacer for a road safety barrier of the type comprising a post and a rail connected to the post via the intermediary of the spacer and connector, whereby the spacer comprises a rail support comprising:

a front face intended to be fastened to a rail, a rear face intended to be fastened to a post and a flange that connects the front face to the rear face, the front face comprising a notch emerging on the upper edge of the front face, the notch comprising a connector housing, located in the lower portion of the notch and two convergent lateral edges connecting the connector housing to the upper edge of the front face.

The spacer of the present invention can also have the optional characteristics listed below, considered individually or in combination:

- the connector housing is a hole, the edge of which is a portion of a circle, the two ends of which are connected to the convergent lateral edges,
- the connector housing is a hole, the edge of which is an half-circle, the diameter of the hole being 1.01 to 1.25 times larger than the diameter of the connector,
- the minimum spacing between the two convergent lateral edges is between one-half and three-quarters of the diameter of the connector,
- the spacing between the two convergent lateral edges is strictly less than the diameter of the connector over at least one-half of the length of the two lateral edges,
- the ratio of the length of the lateral edges to the diameter of the connector housing is between 1 and 3,
- the two convergent lateral edges are segments of a straight line,
- the junction between the two convergent lateral edges and the upper edge of the front face comprises a rounded portion,
- the rail support is a tube with a rectangular or square cross section,
- the rail support is made of steel,
- the lower and/or upper ends of the rail support are beveled so that the rear face of the rail support is longer than the front face of the rail support,
- the spacer also comprises a rail guide that comprises in succession a fastening area suitable for the fastening of the rail guide to a post above a rail support, a connecting piece and a rail reinforcement area suitable for the fastening of the rail guide on the reverse side of the rail,
- the rail guide further comprises an elongated portion, which is located in the extension of the rail reinforcement area and is capable of extending underneath the rail support.

The present invention also provides a safety barrier comprising a post and a rail connected to the post via the intermediary of a spacer claimed by the invention.

The present invention further provides a fabrication kit for a safety barrier comprising a post, a rail, a connector and a spacer as claimed by the invention, whereby the spacer is capable of fastening the rail to the post by means of the connector.

Other characteristics and advantages of the invention will be described in greater detail in the following description.

BRIEF DESCRIPTION OF THE DRAWINGS

The invention will be better understood by reading the following description, which is provided purely for purposes of explanation and is in no way intended to be restrictive, with reference to the attached figures, in which.

DETAILED DESCRIPTION

The same reference numbers represent the same elements in each of the figures.

It should be noted that the terms "top", "bottom", "front", "rear", "above", "below", "upper", "lower" as used in this application refer to the orientation of the different constituent elements of the road safety barrier when they are installed along the roadway.

Throughout the text, bolts will be used as the connector for purposes of simplification. It is possible, however, to provide other connectors to connect the different constituent elements of the road safety barrier to one another. A person skilled in the art will be familiar with the different connectors that are suitable for each case and will use them as a function of his specific requirements.

Throughout the text, a tab means an element that has a thin, narrow and elongated shape. The tab can be in the form of a plate or a sheet consisting of a single material or a composite assembly. In this latter case, the tab is a superposition of a plurality of layers of the same material or of different materials. The material in question can be, among other things, a metal material or a polymer. By way of non-restricting examples, the metal materials can be steel, aluminum, copper or zinc. The tab is preferably a metal sheet. The tab is preferably steel, previously galvanized to protect it against corrosion.

In the framework of the invention, the tab will have been previously formed by means of any known forming process, among which can be cited by way of non-restricting examples bending, profiling, stamping, and die casting.

Figure 1:
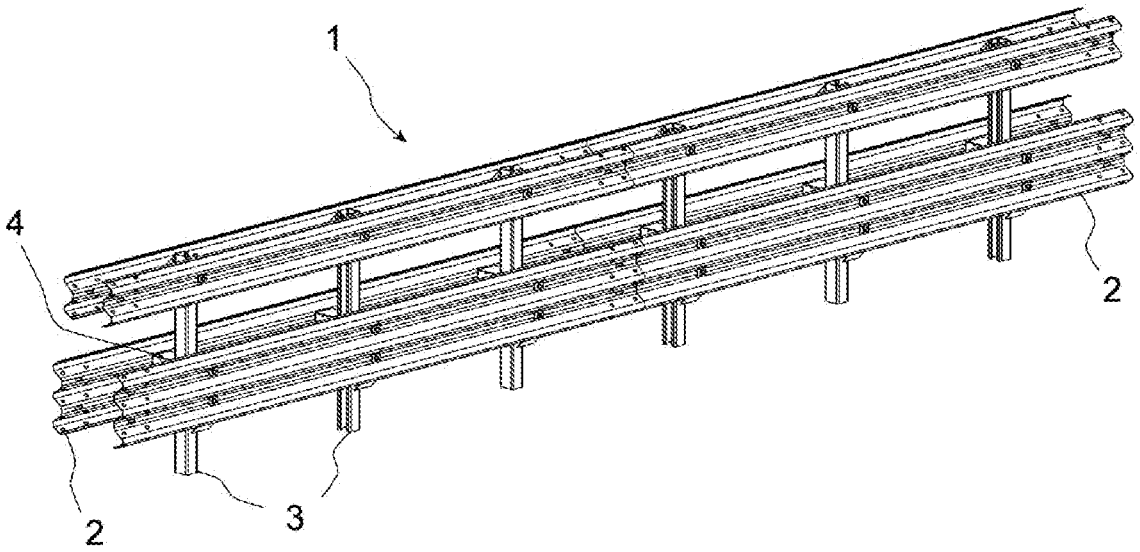
FIG. 1 is a view in perspective of a guardrail comprising a spacer as in a variant of the invention.
Figure 2:
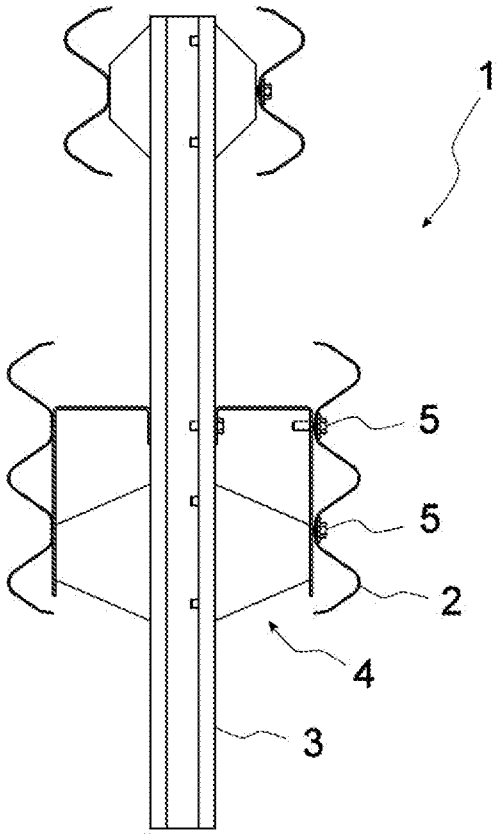
FIG. 2 is a sectional view of a safety guardrail comprising a spacer as in a variant of the invention.

With reference to FIGS. 1 and 2, a road safety barrier 1 comprises a plurality of posts and rails, whereby a given rail 2 is connected to a given post 3 via the intermediary of the spacer 4 and bolts 5.

In the framework of the invention, the shape of the posts and of the rails is not limiting. The posts are generally structural shapes, the cross section of which can be open and be in the shape of a C, a U, an H, a T, a sigma or a Z. Alternatively, the cross section can be closed and can have a round or rectangular or even polygonal shape. The rails are generally very long structural shapes, the cross section of which can be in the shape of a double corrugation, a triple corrugation, a C or even a sigma.

Figure 3:
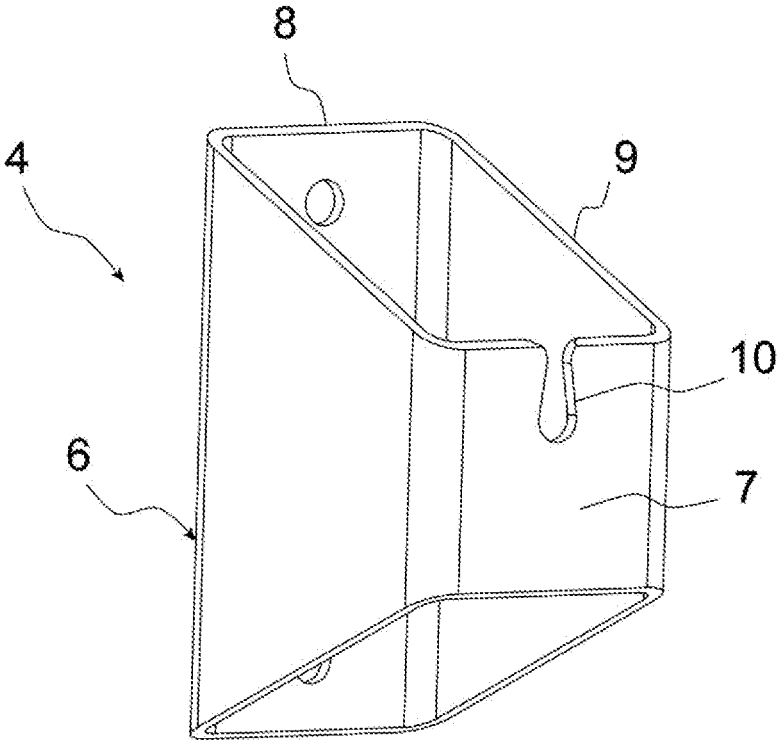
FIG. 3 is a view in perspective of a rail support as in a variant of the invention.

With reference to FIG. 3, the spacer 4 first comprises a rail support 6 comprising a front face 7 designed to be fastened to a rail, a rear face 8 designed to be fastened to a post and a flange 9 connecting the front face to the rear face.

In one variant of the invention, the flange 9 is flat and forms a right angle with the front face on the one hand and with the rear face on the other hand. The geometry and the shape of the flange 9, however, can have other shapes, such as, by way of nonrestrictive examples, a circular arc or undulations, etc.

In one variant of the invention, the flange connects the lateral edges of the front and rear faces of the rail support. However, the flange can alternatively connect the bottom edges of the front and rear faces.

A technician skilled in the art will be able to adapt the geometry, the shape and the position of the flange 9 of the rail support to give it the desired level of restraint and deformability, as a function of local regulatory requirements.

In one variant of the invention, the rail support is a tube with a vertical axis. Depending on the desired strength of the tube, its cross section can have different geometries, such as a polygonal, rectangular, square or even essentially circular cross section. Preferably, the cross section of the tube is rectangular or square so that the tube can more easily bend in the event of an impact and thereby absorb a greater quantity of energy. Moreover, the symmetry of the tube enables the rail support to exhibit the same behavior whether the impact comes from the left or from the right. It is therefore possible to use a single geometry of rail support so that the road safety barrier can be used to protect the left edge or the right edge of the road; this capability facilitates the installation of such a barrier.

The rail support comprises a lower end and an upper end. In particular, the lower end is formed by the bottom edge of the front face 7 and the bottom edge of the rear face 8. Likewise, the upper end is formed by the upper edge of the front face 7 and the upper edge of the rear face 8.

Preferably, the lower and/or upper ends are beveled so that, in the event of an impact, the rail is not torn on the cutting edges of the ends of the rail support. Consequently, the bevel is executed so that the rear face of the rail support is higher than its front face. More specifically, in the case of a beveled upper end, the upper edge of the rear face 8 of the rail support is in a plane that is located above the plane of the upper edge of the front face 7 of the rail support. In the case of a beveled lower end, the bottom edge of the rear face of the rail support is in a plane located below the plane of the bottom edge of the front face of the rail support. The bevels also facilitate the fastening of the spacer to the post of the safety barrier at the level of holes, which are suitable for the passage of bolts, which are preferably located in the upper and/or lower part of the rear face of the rail support.

Preferably, the rail support 6 is made of steel, and more preferably of steel that has an elastic limit between 235 and 600 MPa. In particular, the mechanical characteristics of the steel will be selected from those specified in the pertinent European and US standards, including but not restricted to standards EN10025-2, EN10149, EN10346, ASTM A 1011 and ASTM A 500. Preferably, the rail support 6 has a thickness between 3 and 8 mm to make the optimum operation of the invention possible. A thickness that is too low can present risks of local instability, while a thickness that is too great risks resulting in a rail support that is too strong.

A person skilled in the art will be able to adapt the shape of the rail support, the intrinsic mechanical characteristics of the material and the thickness of the rail support to give the spacer the desired level of restraint and deformability, as a function of local regulatory requirements.

Figure 4:
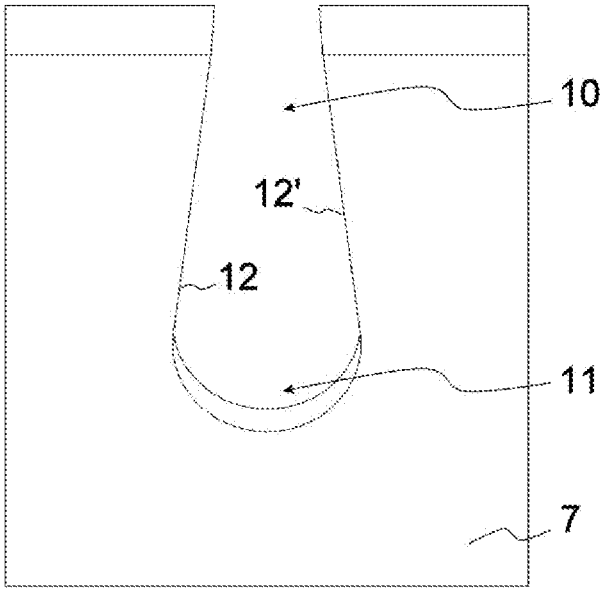
FIG. 4 is a view in perspective of the portion of a rail support comprising a notch as in a first variant of the invention.

With reference to FIGS. 3 and 4, the front face 7 of the rail support 6 also comprises a notch 10 that emerges on the upper edge of the front face. This notch comprises a connector housing 11 located in the lower portion of the notch and two convergent lateral edges 12, 12' connecting the connector housing to the upper edge of the front face.

Throughout the text, the expression "convergent lateral edges" means that the spacing between the lateral edges 12, 12' decreases overall from the connector housing 11 to the upper edge of the front face.

The function of the connector housing 11 is to allow the insertion and holding in place of a connector that provides a connection between the rail and the rail support. For this purpose, its dimensions and its geometry are adapted to the dimensions of the connector, while taking into consideration the clearances necessary for assembly.

Preferably, the connector housing 11 is a hole that is at least partly circular. In other words, the edge of the hole is a portion of a circle, the two ends of which are connected to the two convergent lateral edges. In this case, the diameter of the hole is adapted to the diameter of the connector that provides the connection between the rail and the rail support. In particular, the diameter of the hole is essentially equal to or preferably slightly larger than the diameter of the connector. More preferably, the diameter of the hole is 1.01 to 1.25 times larger than the diameter of the connector. It goes without saying that the diameter of the connector in question is its diameter in a plumb line with the connector housing. Therefore, in the case of a bolt, the diameter in question is the diameter of the threaded shaft.

More preferably, the connector housing is a hole which edge is an half-circle and has a diameter that is 1.01 to 1.25 times larger than the diameter of the bolt. The rail, the rail support and the bolt can therefore be assembled with a good fit. Moreover, in the event of an accidental loosening of the bolt, the rail nevertheless remains properly held in place.

The function of the convergent lateral edges 12, 12' is to make it possible for the bolt to force passage along the length of the notch when it is subjected to a minimum upward force, the force to be exerted to make the bolt advance increasing overall until the bolt is released in response to a maximum applied force. For this purpose, the convergence of the lateral edges makes it possible for the spacing between the two convergent lateral edges 12, 12', to be, at least locally, less than the diameter of the bolt.

Preferably, the minimum spacing between the two convergent lateral edges 12, 12' is between one-half and three-quarters (¾) of the diameter of the bolt. Such minimum spacing makes it possible to give a certain but not excessive resistance to the bolt rising. More preferably, the minimum spacing between the two convergent lateral edges 12, 12' is between three-fifths (⅗) and four-fifths (⅘) of the diameter of the bolt, Preferably, the spacing between the two convergent lateral edges 12, 12' is strictly less than the diameter of the bolt over at least one-half of the length of the two lateral edges. This configuration makes possible a satisfactory dissipation of energy. More preferably, the spacing between the two convergent lateral edges 12, 12' is strictly less than the diameter of the bolt over at least two-thirds of the length of the two lateral edges. The dissipation of energy is then even greater.

Preferably, the two convergent lateral edges 12, 12' are straight line segments. Therefore, the resistance of the notch to the rise of the bolt in the event of an impact increases in an approximately straight-line fashion with the distance traveled by the bolt. However, other shapes can also be considered as a function of the desired disconnection profile. By way of nonrestrictive examples, mention can be made of parabolic, hyperbolic, stair-step and sawtooth lateral edges.

Preferably, the convergent lateral edges 12, 12' are symmetrical along a vertical axis that runs through the center of the connector housing 11. This symmetry enables the spacer to exhibit the same behavior whether the impact comes from the left or from the right. This symmetry, which is along the longitudinal axis of the rail support, also makes it possible to use a single spacer geometry whether the safety barrier is intended to be installed on the left edge or the right edge of the road; this capability facilitates the installation of such a barrier.

Preferably, the ratio of the length of the lateral edges to the diameter of the connector housing is between 1 and 3. The sufficient length of the convergent lateral edges compared to the diameter of the connector housing makes possible a greater dissipation of energy without thereby making the disconnection time too long and potentially too late.

By way of example, the lateral edges can have a length on the order of 20 to 40 mm for a connector housing that has a diameter on the order of 18 mm.

In one variant of the invention, the notch 10 is formed by a half-circular connector housing 11 with a diameter that is 1.01 to 1.25 times greater than the diameter of the bolt and by two convergent lateral edges 12, 12' that are segments of a straight line, whereby each of the lateral edges is an extension of an end from the half-circle to the upper edge of the front face. A configuration of this type makes it possible to oppose a resistance to the movement of the bolt when the bolt seeks to leave the connector housing under the upward pressure of an impact.

Figure 5:
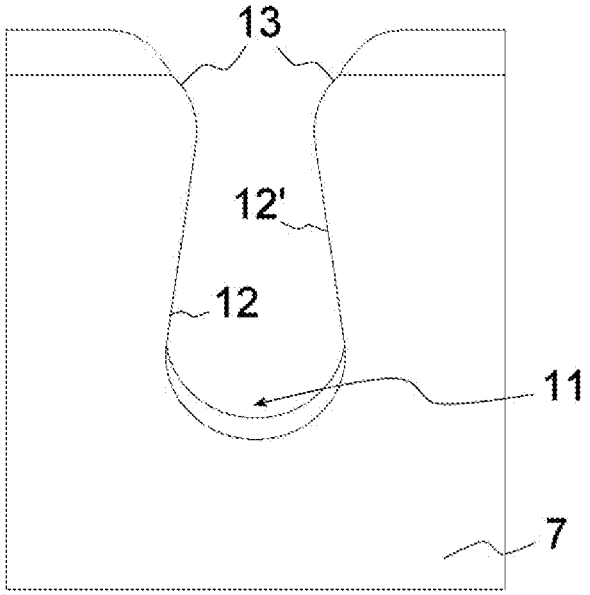
FIG. 5 is a view in perspective of the portion of a rail support comprising a notch as in a second variant of the invention.

Preferably, the junction between the convergent lateral edges 12, 12' of the notch and the upper edge of the front phase 7 has a rounded portion 13 as illustrated in FIG. 5. This makes it possible, for higher tightening torques (i.e., greater than 100 Nm), to prevent the upper ends of the lateral edges of the notch from being torn away when the bolt reaches this area and from becoming jammed between the rail support and the rail, thereby reducing the likelihood that one part will slip in relation to the other. By rounding off this junction, the maximum force that must be applied to produce the disconnection can thereby be set with greater reliability.

Preferably, the radius of curvature of the rounded portion is on the order of 8 to 13 mm.

The notch 10 can be created by any method known to a person skilled in the art such as, by way of nonrestrictive examples, punching, milling, mechanical cutting, laser cutting, plasma cutting, water jet or oxyacetylene cutting.

Figure 6:
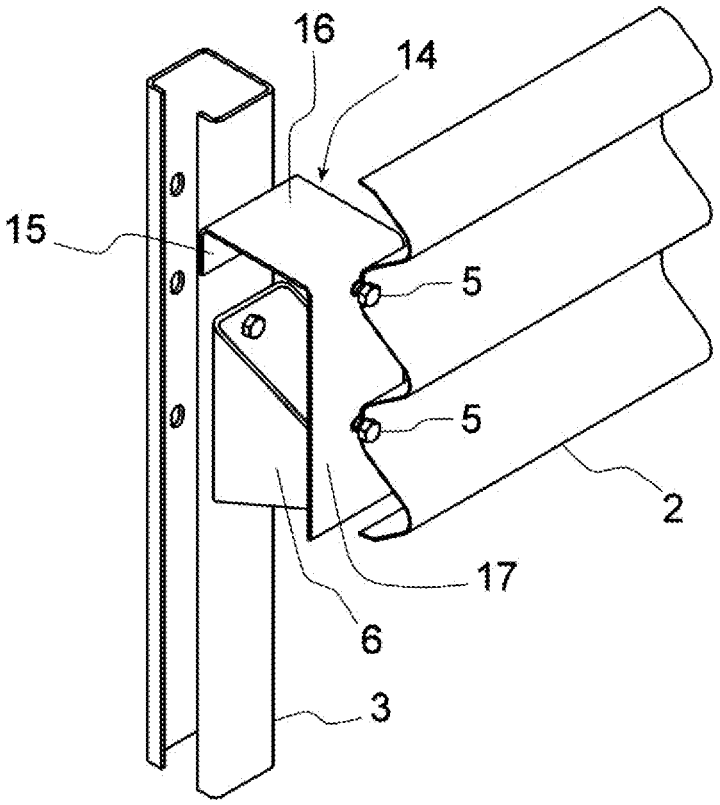
FIG. 6 is a view in perspective of a spacer as in a variant of the invention.

Preferably, the spacer also comprises a rail guide 14 located between the post 3 and the rail 2, above the rail support 6, as illustrated in FIG. 6. The rail guide makes it possible for the rail to rise in a controlled manner, after the bolt 5 is released, via the notch 10. In particular, the function of the rail guide is to control the upward movement of the rail after its detachment from the rail support, to more effectively contain heavy vehicles by making the rail rise, for example to the level of the vehicle axles, while preventing the rail from rising too far, for example above the vehicle axles. An excessive rise of the rail would allow the vehicle wheels to reach the posts of the safety barrier and thus to damage the latter.

To ensure this function, the rail guide 14 comprises in succession a fastening area 15 suitable for the fastening of the rail guide to a post above a rail support, a connecting piece 16 and a rail reinforcement area 17 suitable for the fastening of the rail guide on the reverse side of the rail.

Therefore, in the event of an impact that causes the disconnection of the rail from the rail support, the connecting piece 16 is inclined toward the post under the pressure of the vehicle. Consequently, the rail is driven upward within the limits set by the dimensions of the rail guide.

Figure 7:
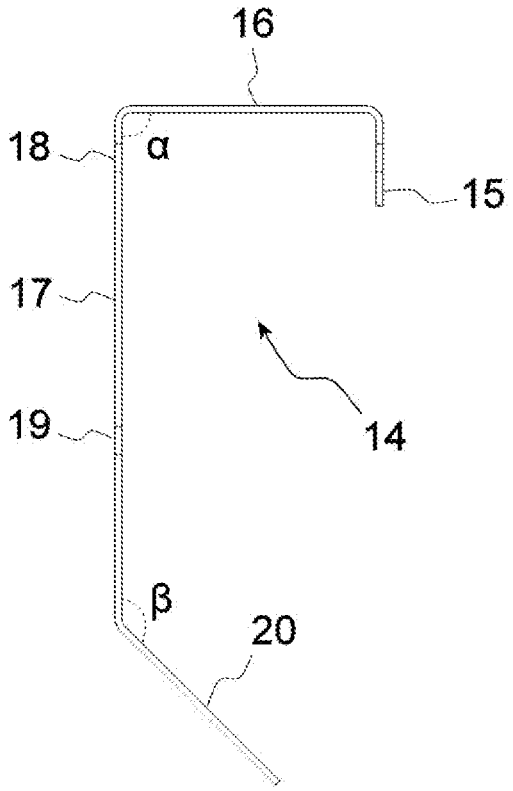
FIG. 7 is a longitudinal section of a spacer tab as in one variant of the invention.

In one variant illustrated in FIG. 7, the rail guide is in the shape of a tab comprising in succession a first vertical branch that serves as a fastening area 15 and is designed to be fastened to the post, a connecting piece 16 and a second vertical branch that acts as a rail reinforcement area 17 and is designed to be fastened to the reverse side of the rail.

The first vertical branch 15 makes it possible to fasten the tab to the post above the rail support. The first vertical branch 15 is therefore preferably perforated with a hole for the passage of a bolt. It is preferably oriented downward from the connecting piece 16. Therefore, in the event of an impact that results in the disconnection of the rail from the rail support, the tab is easily unfolded at the intersection of the first vertical branch and the connecting piece, thereby more easily driving the rail upward.

The first vertical branch 15 is extended by a connecting piece 16 that extends forward. Its length is adapted so that the forward end of the connecting piece is located approximately in the plane of the front face of the rail support when the first vertical branch is fastened to a post. The connecting piece is preferably horizontal to minimize the quantity of material necessary to reach the plane of the front face of the rail support. In one variant, it is inclined so that the angle $\alpha$ between the connecting piece and the second vertical branch is less than 90°. In the event of an impact that results in the disconnection of the rail from the rail support, this configuration facilitates the bending of the tab at the intersection of the connecting piece and the second vertical branch and thus the rise of the tab and of the rail that is connected to it.

The connecting piece 16 is extended downward by a second vertical branch 17. In the illustrated variant, it comprises a rail fastening area 18 located in the upper portion of the second vertical branch.

Preferably, the second vertical branch at least partly covers the front face 7 of the rail support 6. It can thereby be inserted between the rail support 6 and the rail 2. The rail guide therefore constitutes a shield between the rail and the rail support, so that the rail is less damaged, in the event of an impact, by the single point represented by the rail support. In the variant illustrated in FIG. 7, the second vertical branch 17 therefore has a length such that the second vertical branch can be inserted between the rail support 6 and the rail 2. The second vertical branch 17 increases the rigidity of the rear portion of the rail and thereby prevents it from becoming embedded in the rail support in the event of an impact, which would locally reduce the level of restrain provided by the rail.

Preferably, the second vertical branch 17 also comprises a second rail fastening area 19 located in the lower portion of the second vertical branch so that the rail is fastened in two points and is therefore more effectively held in position. Preferably, the second rail fastening area 19 also constitutes a fastening area to the rail support 6 at the level of the notch 10, such that the rail 2, the rail guide 14 and the rail support 6 can be connected by a single bolt. In other words, the rail reinforcement area 17 of the rail guide 14 can be fastened to the notch 10 of the rail support 6.

Preferably, the second vertical branch 17 extends downward farther than the lower end of the rail support, in particular lower than the lower edge of the front face 7 of the rail support, so that the rail guide constitutes a shield between the rail and the rail support over the full height of the rail support.

The rail guide preferably also comprises an extension 20 which is located in the elongated portion of the rail reinforcement area 17 and which extends underneath the rail support. For this purpose, the angle $\beta$ between the rail reinforcement area 17 and the elongation 20 is less than 180°, preferably in the range between 120 and 150°. This elongation further improves the rise of the rail along the rail support, after the disconnection of the rail from the rail support, by preventing the rail from tearing on the cutting edges of the lower end of the rail support.

A person skilled in the art will be able to adapt the dimensions and geometry of the rail guide so that the guide rises in the desired proportions after its disconnection from the rail support and also so that the rail is at the desired level to effectively restrain a heavy vehicle. In particular, a person skilled in the art will be able to adapt the respective dimensions and geometries of the constituent elements of the rail guide relative to the dimensions and geometry of the rail support such that the rail rises in the desired proportions after its disconnection from the rail support and thus so that the rail is at the desired level to ensure the effective restraint of a heavy vehicle.

By way of example, in the case illustrated in FIG. 6, the rail support 6 and the rail guide 14 have the following dimensions:

- height of the rear face 8 of the rail support: 25.4 cm,
- height of the front face 7 of the rail support: 10.16 cm
- width of the front and rear faces of the rail supports: 13.33 cm
- width of the flange 9 of the rail support: 18.44 cm
- angle $\alpha$: 90°
- height of the first vertical branch 15 of the rail guide: 6.86 cm
- length of the connecting piece 16 of the rail guide: 18.9 cm
- length of the second vertical branch 17 of the rail guide: 35.1 cm
- angle between the second vertical branch and the elongation: 135°
- length of the extension 20 of the rail guide: 15 cm
- width of the rail guide: 15.24 cm
- distance separating the upper edge of the rear face 8 of the rail support from the lower edge of the first vertical branch 15 of the rail guide: 6.54 cm With a spacer that has a notch 10 claimed by the invention, a person skilled in the art will be capable of adapting the threshold disconnection value, the disconnection time and the disconnection profile on a case-by-case basis. All that a person skilled in the art will be required to do is to adjust the length of the notch, the shape of the lateral edges and the spacing between them. Simple computer calculations or mechanical tests can be used to quickly determine the desired disconnection characteristics.

Figure 8:
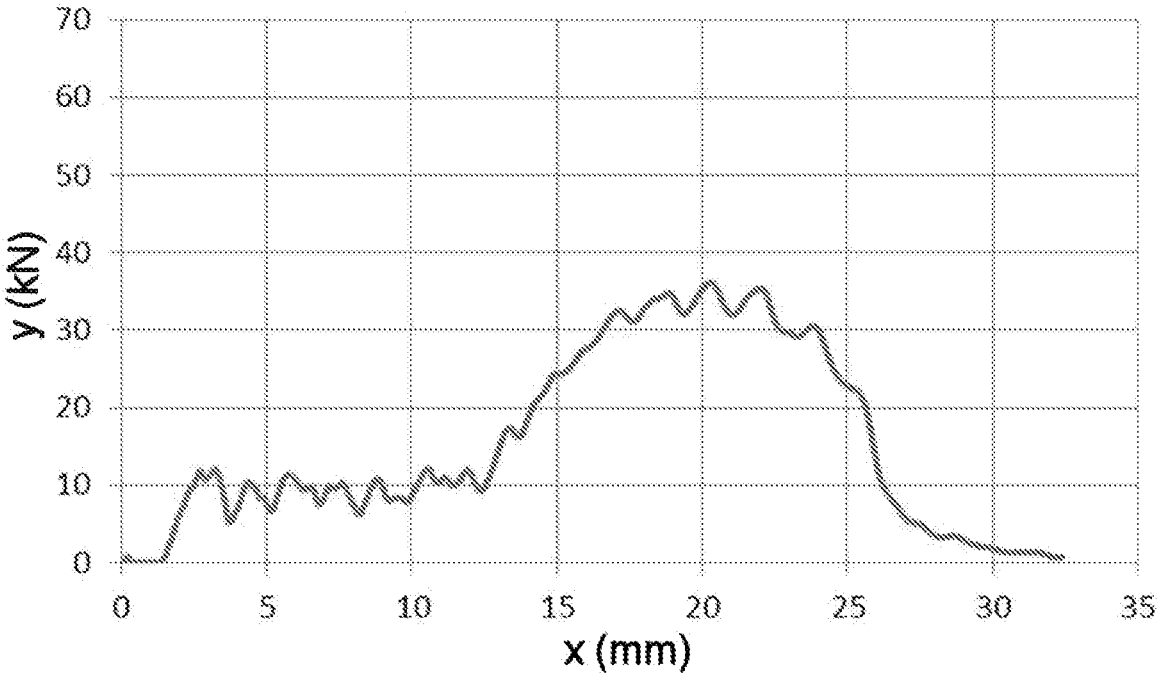
FIG. 8 is a result of a mechanical test done on the spacer claimed by the invention in the event of an impact, the result being presented in the form of a curve representing the tensile force (in kN) exerted on a bolt connecting a rail to the spacer as a function of the vertical displacement of this bolt (in mm).

One example of a mechanical test is illustrated in FIG. 8, in the form of a disconnection profile representing the tensile force exerted (reference y, in kN) on a bolt connecting a rail to the rail support as a function of the vertical displacement of this bolt (reference x, in mm). This test was conducted for the case of a rail support that has the following characteristics:

Tube with rectangular cross section and beveled ends
Semicircular connector housing with a diameter of 18 mm
Straight line convergent lateral edges
Length of the convergent lateral edges: 30 mm
Minimum spacing between the lateral edges: 10 mm
Thickness of the front face of the rail support: 6.4 mm
The diameter of the threaded shaft of the bolt was 16 mm.

It has been determined that the force to be exerted to tear the rail from the rail support increases progressively until it reaches a maximum on the order of 36 kN for a displacement of the bolt on the order of 20 mm along the notch. The force to be exerted then decreases progressively until the rail disconnects from the rail support at the upper end of the notch.

It therefore appears that the threshold disconnection value is reached when the bolt has not yet reached the upper end of the notch. This has the major advantage of depending to a lesser extent on the manufacturing tolerances at the upper end of the notch, where the two convergent lateral edges are closest to each other and where it would have been expected that any lack of precision during the fabrication would modify the threshold disconnection value.

Without wishing to be bound to a scientific theory, it seems that this phenomenon is related to the quantity of material remaining downstream of the moving bolt. Near the upper end, only a small triangle of material resists the passage of the bolt. At this level, the force to be exerted to displace the bolt drops progressively.

The invention has been described in the case of the integration of a spacer into a road safety barrier. However, the spacer claimed by the invention is naturally not limited to this single utilization. It is easy to visualize potential utilizations for other types of road safety equipment.

What is claimed is:

1. A spacer for a road safety barrier, the road safety barrier having a post and a rail connected to the post via the spacer and a connector, the spacer comprising:

a rail support comprising:
a front face designed to be fastened to the rail;
a rear face designed to be fastened to the post; and
a flange connecting the front face to the rear face;

the front face comprising a notch emerging on an upper edge of the front face, the notch comprising a connector housing, located in a lower portion of the notch and two convergent lateral edges connecting the connector housing to the upper edge of the front face.

2. The spacer as recited in claim 1, wherein the connector housing is a hole, an edge of which is a portion of a circle, two ends of the connector housing are connected to the two convergent lateral edges.

3. The spacer as recited in claim 2, wherein the connector housing is a hole, the edge of which is a semi-circle, a diameter of the hole being 1.01 to 1.25 times larger than a diameter of the connector.

4. The spacer as recited in claim 1, wherein a minimum spacing between the two convergent lateral edges is between one-half and three-quarters of a diameter of the connector.

5. The spacer as recited in claim 1, wherein a spacing between the two convergent lateral edges is strictly less than a diameter of the connector over at least one-half of a length of the two convergent lateral edges.

6. The spacer as recited in claim 1, wherein a ratio of a length of the two convergent lateral edges to a diameter of the connector housing is between 1 and 3.

7. The spacer as recited in claim 1, wherein the two convergent lateral edges are straight-line segments.

8. The spacer as recited in claim 1, wherein a junction between the two convergent lateral edges and the upper edge of the front face comprises a rounded portion.

9. The spacer as recited in claim 1, wherein the rail support is a tube with a rectangular or square cross section.

10. The spacer as recited in claim 1, wherein the rail support is made of steel.

11. The spacer as recited in claim 1, wherein the lower or upper ends of the rail support are beveled so that the rear face of the rail support is longer than the front face of the rail support.

12. The spacer as recited in claim 1, further comprising a rail guide including, in succession, a fastening area suitable for fastening the rail guide to the post above the rail support, a connecting piece and a rail reinforcement area suitable for fastening the rail guide on a reverse side of the rail.

13. The spacer as recited in claim 12, wherein the rail guide further includes an extension, located in the extended portion of the rail reinforcement area and capable of extending underneath the rail support.

14. The spacer as recited in claim 1, wherein the rail support is made of steel.

15. The spacer as recited in claim 14, wherein the rail support has a thickness between 3 mm and 8 mm.

16. The spacer as recited in claim 14, wherein the steel has an elastic limit between 235 and 600 MPa.

17. A road safety barrier comprising:

a post;
a rail;
a connector; and
a spacer including a rail support comprising a front face designed to be fastened to the rail; a rear face designed to be fastened to the post and a flange connecting the front face to the rear face;
the front face comprising a notch emerging on an upper edge of the front face, the notch comprising a connector housing, located in a lower portion of the notch and two convergent lateral edges connecting the connector housing to the upper edge of the front face;
the post and the rail being connected via the spacer and the connector.

18. The road safety barrier as recited in claim 17, wherein the connector is a bolt.

19. The road safety barrier as recited in claim 17, wherein the connector is a bolt and the connector housing is a hole, the diameter of the hole being 1.01 to 1.25 larger than the bolt.

20. A fabrication kit for a safety barrier comprising:

a post;
a rail;
a connector; and
a spacer, the spacer including a rail support comprising a front face designed to be fastened to the rail; a rear face designed to be fastened to the post and a flange connecting the front face to the rear face;
the front face comprising a notch emerging on an upper edge of the front face, the notch comprising a connector housing, located in a lower portion of the notch and two convergent lateral edges connecting the connector housing to the upper edge of the front face;
the spacer being capable of fastening the rail to the post via the connector.

* * * * *